US007040899B2

(12) United States Patent
Armstrong

(10) Patent No.: US 7,040,899 B2
(45) Date of Patent: May 9, 2006

(54) PORTABLE PRESENTATION DISPLAY

(76) Inventor: Ronald G. Armstrong, 651 Quarterline Rd. Box 671, Newaygo, MI (US) 49337

( * ) Notice: Subject to any disclaimer, the term of this patent is extended or adjusted under 35 U.S.C. 154(b) by 58 days.

(21) Appl. No.: 10/807,444

(22) Filed: Mar. 24, 2004

(65) Prior Publication Data

US 2005/0074740 A1 Apr. 7, 2005

Related U.S. Application Data

(60) Provisional application No. 60/456,521, filed on Mar. 24, 2003.

(51) Int. Cl.
*G09F 7/00* (2006.01)

(52) U.S. Cl. ..... 434/430; 434/428; 160/135; 40/605

(58) Field of Classification Search ..... 434/428, 434/430, 365; 160/135; 40/605; 50/800.11
See application file for complete search history.

(56) References Cited

U.S. PATENT DOCUMENTS 2,867,045 A * 1/1959 Millgate ..... 434/426
3,629,960 A * 12/1971 Roush ..... 434/429
4,711,046 A 12/1987 Herrgord
4,722,146 A * 2/1988 Kemeny ..... 40/605
4,919,259 A 4/1990 Beaulieu
4,926,609 A 5/1990 Arico
5,125,193 A * 6/1992 Beaulieu ..... 52/71
5,269,524 A * 12/1993 Womack ..... 273/157 R
5,439,043 A 8/1995 Carter
5,791,391 A 8/1998 Carter
5,984,092 A 11/1999 Heard-Willmon
6,189,594 B1 2/2001 Carter
6,767,215 B1 * 7/2004 Robertson ..... 434/432

FOREIGN PATENT DOCUMENTS

EP 0131296 1/1985

* cited by examiner

*Primary Examiner*—Dmitry Suhol
(74) *Attorney, Agent, or Firm*—Richard C. Litman

(57) ABSTRACT

A ultra light presentation display case is a slim, lightweight portable case that can be easily carried to the site of a presentation. The case easily folds open to provide a multi surfaced, free standing exhibit display. The display case comprises three lightweight, rigid structural panels, each panel encapsulated by a rigid frame, the three panels hinged together, allowing the two outer panels to be folded towards the center panel, and a handle fixedly secured to the top of the center structural panel. Each of the panels is made from a rigid, lightweight polystyrene foam core. The front surface of the panels is covered with a Velcro® compatible loop material. The rear surface of the panels is covered with a thermoplastic polymer that is heated and formed to create a corrugated pattern providing both structural integrity and an embossed area wherein a logo or other advertising can be affixed.

10 Claims, 4 Drawing Sheets

PORTABLE PRESENTATION DISPLAY

CROSS-REFERENCE TO RELATED APPLICATION

This application claims the benefit of U.S. Provisional Patent Application Ser. No. 60/456,521, filed Mar. 24, 2003.

BACKGROUND OF THE INVENTION

1. Field of the Invention

The present invention relates to portable presentation display cases, and more particularly to lightweight and portable, presentation display cases.

2. Description of Related Art

There are many different devices and systems for displaying exhibits at presentations. Many of the existing devices include structures that must be erected at the site of the presentation. These structures generally include support frames and interconnecting panels with a display surface that allows exhibits to releasably attach to the panels. It is time consuming and inefficient to have to construct a presentation display once you are at the presentation. In business meeting situations there is often a very limited amount of time set aside for a presentation and it is inefficient to spend most of that time constructing your presentation display.

Several existing display devices have been designed that are preassembled and can be carried to the site of the presentation. The preassembled display devices typically include a plurality of panels that are folded or rolled up. Once the display device is brought to the site of the presentation it may be unfolded and put in place without having to construct the device. Exhibit items are then attached to the interior surfaces of the panels to be displayed. The following documents disclose existing presentation display devices.

U.S. Pat. No. 6,189,594 issued to Carter discloses a portable display case having a plurality of panel members with a hollow construction formed from a polymeric/copolymeric plastic material. The display surfaces of the panels are covered with a sheet of aesthetic fabric material. The display case also includes a retractable handle for carrying the case. The retractable handle includes a gripping handle and a pair of parallel legs with stopping mechanisms that prevent the handle from being totally withdrawn from the center panel.

U.S. Pat. No. 5,791,391 issued to Carter discloses a display system having two display sections that may be attached or used separately. When attached the display system is used as a floor display. When separated the display system is used as table display. The panel is preferably constructed as a laminate defined by a polymeric or copolymeric plastic member, which is bonded to a fabric layer. The panel portions are rolled in opposite directions to define a columnar upstanding side portion at each side of a third center portion.

U.S. Pat. No. 5,984,092, issued to C. Heard-Willmon in November 1999, discloses an organizer for carrying numerous samples or other items within a structure that folds to a compact size for carrying.

U.S. Pat. No. 5,439,043 issued to Carter discloses a display system spanning two sets of stacked hollow columns. Each column is formed of a sheet of resilient material folded to bring opposite edges into relationship with one another. The edges are secured together with clips or magnets. The cylinders at each end of the system give support to the display panel that spans from one cylinder to the other. The plastic cylinders allow the display to stand upright to display items of interest.

U.S. Pat. No. 4,926,609 issued to Arico discloses a freestanding knockdown exhibit display having a plurality of structural panels that are connected by flexible hinges to form a pair of panel sections. The exhibit display is erected by connecting the structural panels to one another. The display system includes decorative overlays that are connected to the front surface of each of the panels. The decorative overlays are made of a Velcro material for attaching display items onto the panels. A plurality of shelves may be attached to the decorative overlay surfaces. The structural panels are constructed from acrylonitrile butadiene styrene or other suitably strong material. The structural panels are corrugated with a plurality of ribs. The structural integrity of the panels is achieved by laterally spacing the ribs.

U.S. Pat. No. 4,919,259 to Beaulieu discloses a portable display case. The portable display case includes three panels made from a thermoplastic material. The three panels are connected along their edges by hinges. The three panels may be folded to form a carrying case. The case further includes a handle attached to the center panel for carrying the case in its closed position. The interior surface of the panels is covered with a Velcro material for attaching display items to the panels.

U.S. Pat. No. 4,711,046 issued to Herrgord discloses a lightweight multi-panel display system comprising a plurality of rectangular panels formed of a foam core laminate interconnected at adjacent side edges by flexible plastic strip hinges fastened in slots adjacent the side edges of the panels. The individual panels are comprised of lightweight laminated foam having a rigid polystyrene core. The center panels include a smooth fabric outer surface where display items or signs may be displayed. The panels fold along the hinges so the display system may be carried.

Lastly, European Patent Publication No. 0131296, published in January 1985, discloses a display stand having a baseboard linked thereto, and a support board linked to the display board. The baseboard has a vertically upright edge web on all its sides so that the display stand can be easily opened and supported in a sturdy fashion.

What is further needed is a slim tri-fold extremely lightweight display case having the molded exterior panels and frame providing protection from damage during transportation. None of the above inventions and patents, taken either singly or in combination, is seen to describe the instant invention as claimed.

SUMMARY OF THE INVENTION

The present invention is an ultra light portable presentation display case. The applicant, prior to the development of the product herein disclosed, had previously offered a display case with a vinyl covering. Desiring a more durable display case, the tri-fold display case is a slim, lightweight portable case that can be easily carried to the site of a presentation. At the presentation site the case easily folds open to provide a multi surfaced, free standing exhibit display.

A preferred embodiment of the tri-fold presentation case has three lightweight support frames secured together by a flexible hinge mechanism. Within each frame, is a panel made of rigid lightweight material, preferably a rigid polystyrene foam core faced on both sides by smooth, moisture resistant wood fiber veneers. Each of the structural panels includes a front surface and a rear surface. The front surface of the panels is covered with a Velcro® loop compatible material. The Velcro compatible material allows exhibit items to be releasably secured to the front surface of the panels for display. The rear surface of the panels is covered with a thermoplastic polymer. The thermoplastic polymer is heated and formed to create a design with an embossed area where a domed logo or other advertising can be affixed.

The rigid support frame encapsulates the panels. The rigid support frame is permanently secured to the edges of the structural panels utilizing an adhesive. The support frame holds the panels in place and creates a freestanding display structure for presentation exhibits. The rigid support frame also protects the panels from damage due to normal wear and tear during transportation of the portable display case.

The presentation display case preferably comprises a main center panel and two outer panels making the unit a tri-fold display case. The outer panels are secured to either side of the center panel by a flexible hinge. The hinge allows the outer panels to fold from an open position to a closed position. In the open position the tri-fold presentation case provides a freestanding means for displaying exhibits. In the closed position the tri-fold presentation case provides a lightweight case that is easily carried to the presentation site. The handle is riveted to the top of the center panel to allow the display case to be easily carried.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
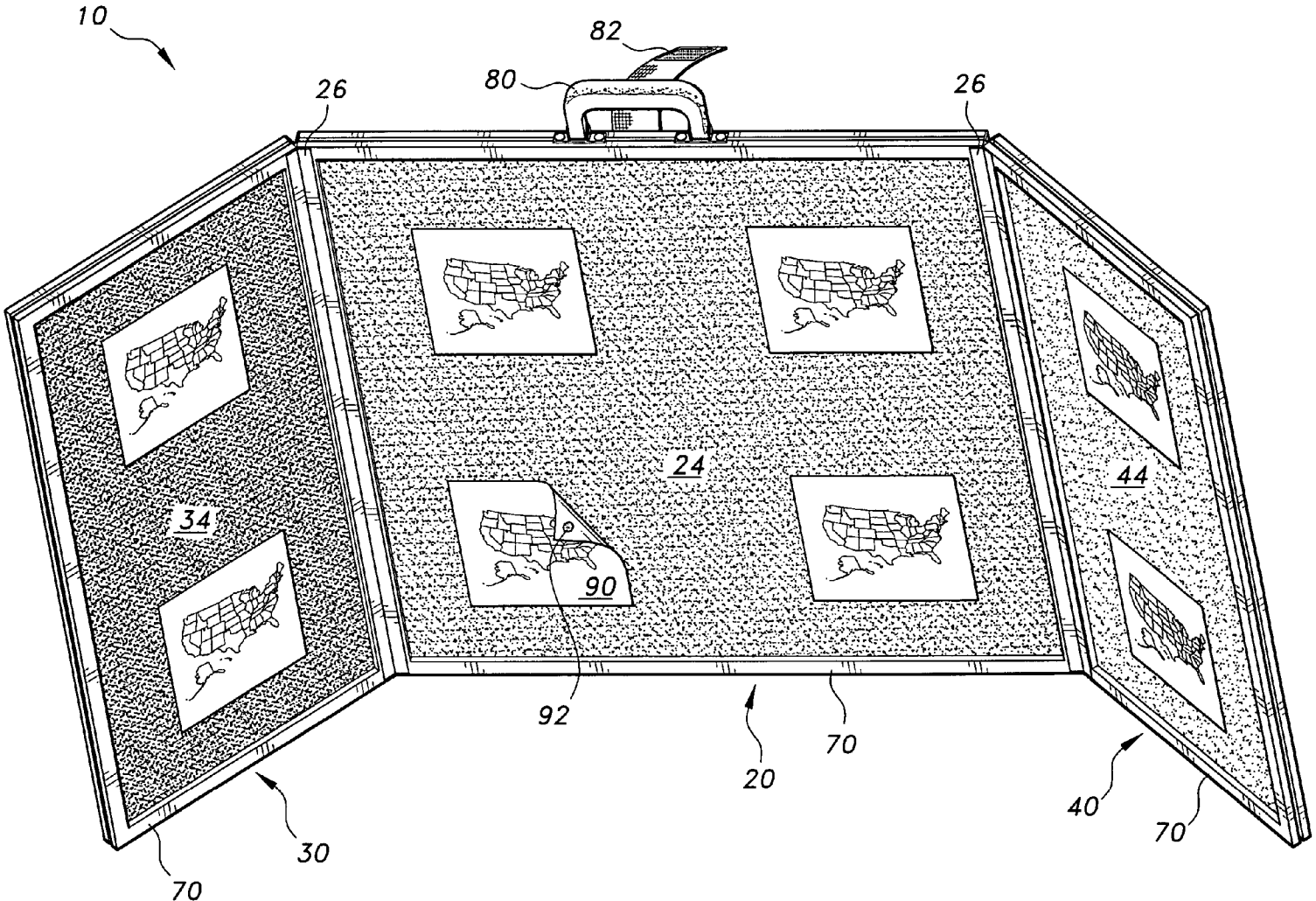
FIG. 1 is a perspective view of an ultra light tri-fold presentation display case in an open position according to the present invention.
Figure 2:
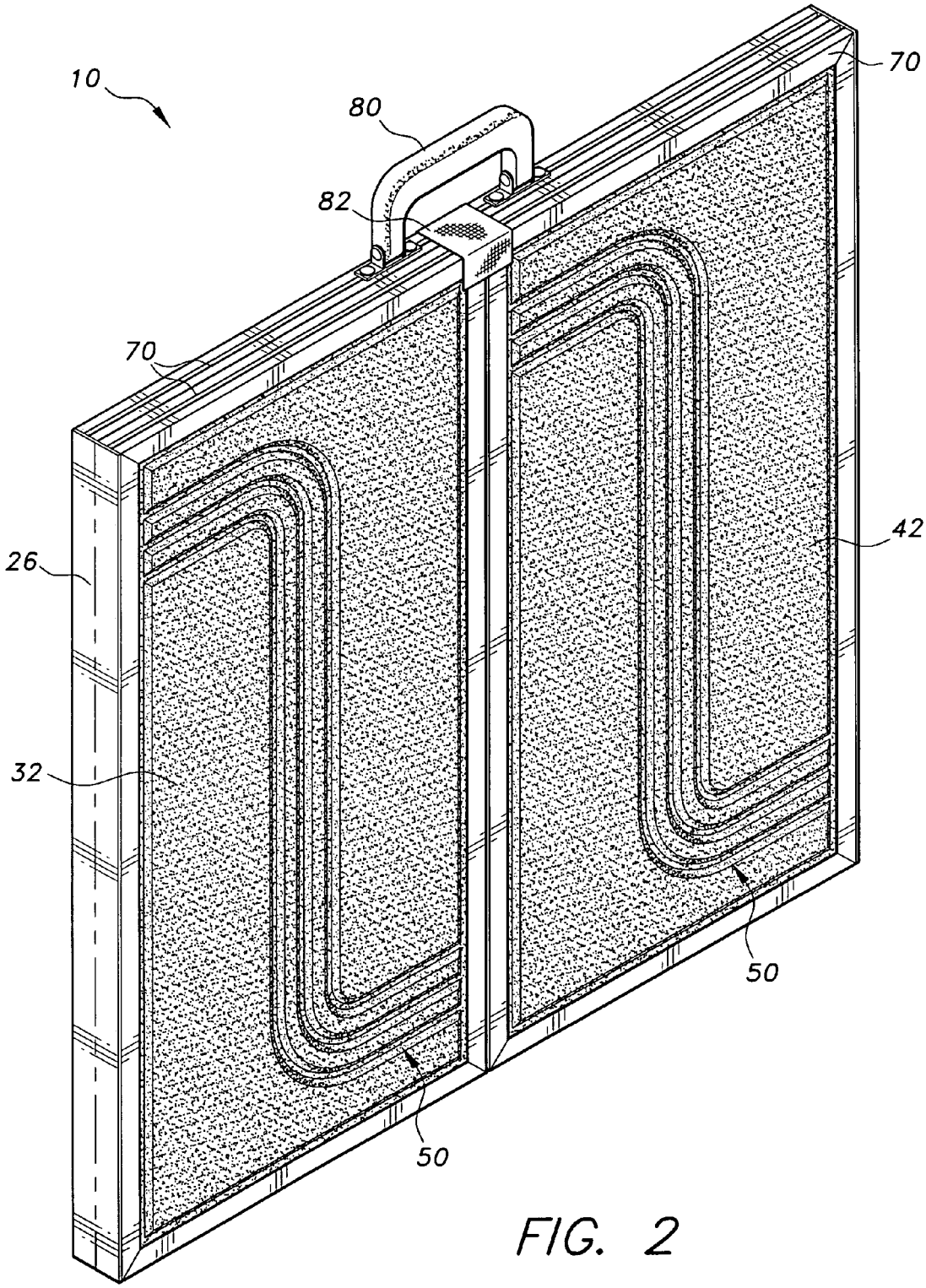
FIG. 2 is a perspective view of the tri-fold presentation display case in a closed position.

The present invention is an ultra light presentation display case designated generally as 10 in drawings. The folding display is a slim, lightweight portable case that can be easily carried to the site of a presentation. At the presentation site the case easily folds open to provide a multi surfaced, free standing exhibit display. FIG. 1 is a perspective view depicting the display case 10 in an open position. In the open position the display case 10 is a freestanding, tabletop exhibit display. FIG. 2 is a perspective view depicting the display case 10 in a closed position. In the closed position the display case 10 provides a lightweight portable case that is easily carried to the site of the presentation.

Figure 3:
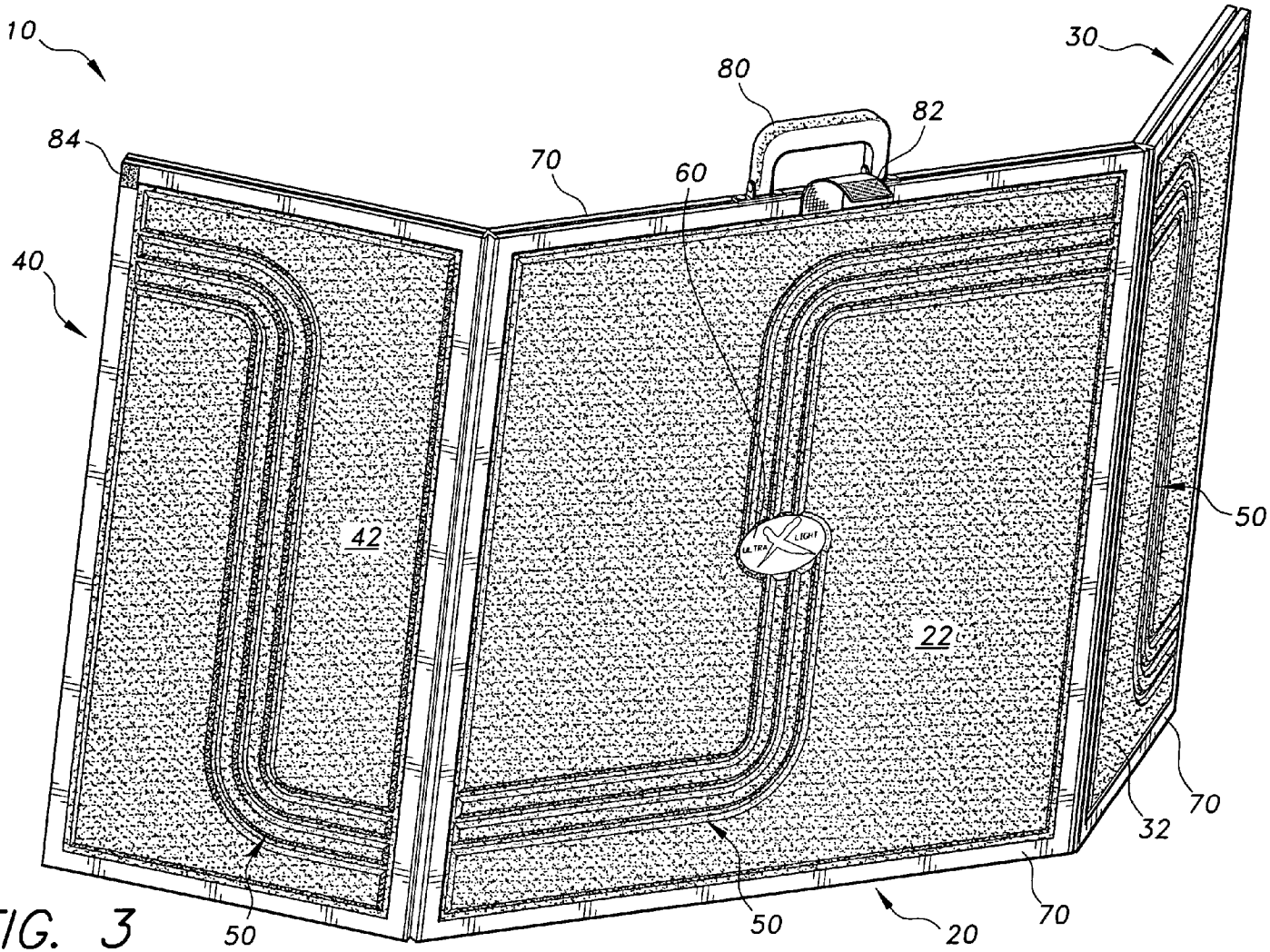
FIG. 3 is a rear perspective view of the tri-fold presentation display case.

FIG. 3 is a rear perspective view of the display case 10 in its open position. In the preferred embodiment shown in FIG. 3, the display case 10 comprises a center panel 20, a first wing panel 30 and a second wing panel 40. Although the present embodiment discloses three panels, the number of panels is not limiting.

The first wing panel 30 and the second wing panel 40 are foldably to either side of the center panel 20 by a hinge and secured in place by a Velcro® strap 82 extending from the rear of the center panel 20 over the tops of the panels and fastened to a pair of Velcro® pads 84 disposed on the rear top outside corners of the wing panels 30, 40. The hinges 26 are preferably a Mylar tape hinge 26, but are not limited in this manner and any securing means that allows the wing panels 30 and 40 to be folded from an open position to a closed position may be used.

Figure 4:
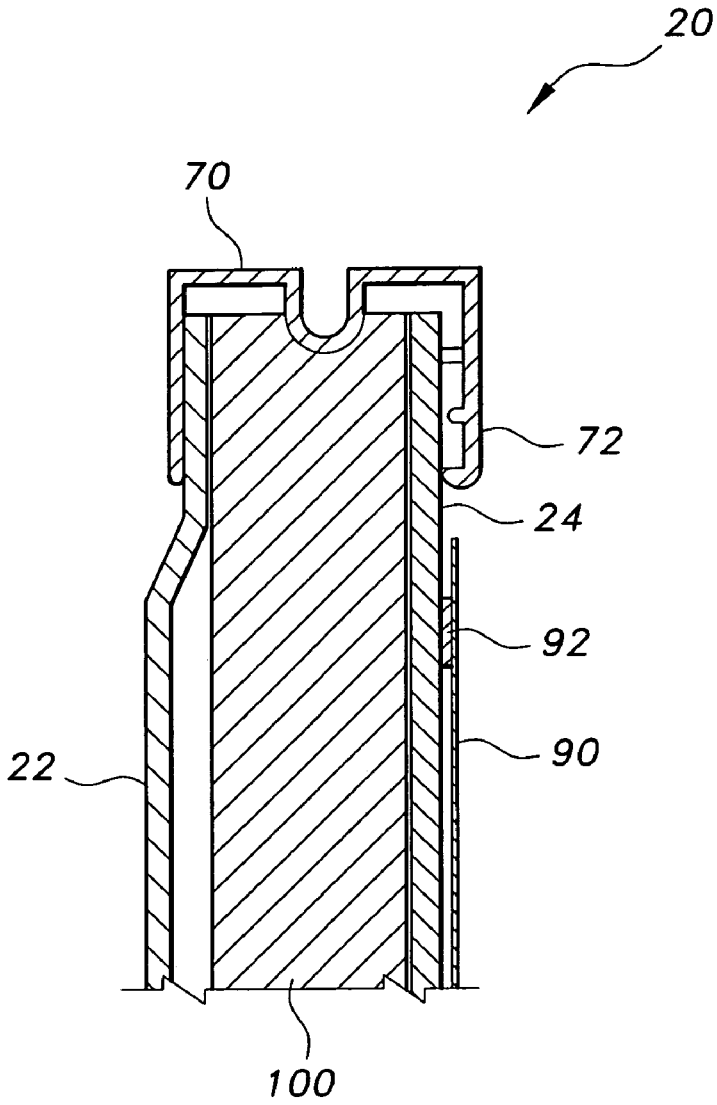
FIG. 4 is cross sectional view of a structural panel of the tri-fold presentation display case.

Each of panels 20, 30, and 40 further comprises a support frame 70 best illustrated in FIG. 4 that encapsulates the structural panels. When the display case 10 is in its open position such as during a presentation, the plurality of support frames 70 provides a freestanding structure enabling the display case 10 to stand free. The support frame 70 also protects the panels from damage while the display case 10 is transported and used in presentations. Although the support frame 70 may be made from plastic, aluminum, or any rigid material that will provide the desired degree of support and protection for the panels, in a preferred embodiment the support frame 70 is made of polyvinyl chloride.

The display case 10 has a handle 80 for easily lifting and carrying the display case 10. Not limiting, the handle 80 is preferably riveted to the support frame 70 of the center panel 20. When the wing panels 30 and 40 are folded in the closed position the handle 80 allows the display case 10 to be carried like a common brief case.

The rear portion of the display case 10 has a ribbed pattern 50 that begins on the rear surface 42 of the second wing panel 40, extending across the rear surface 22 of center panel 20 and rear surface 32 of the first wing panel 30. The ribs 50 provides a high degree of rigidity to the rear surface of each panel and protects the display case 10 from external forces applied against the panel. A recessed area 60 thermoformed in the center of the rear surface 22 of center panel 20 provides further structural integrity to the panel 20 as well as providing an area to which a customer may affix a logo or other advertising media.

Referring to FIG. 1, the center panel 20 has a front surface 24, and the two wing panels 30, 40 have front surfaces 34, 44. Each front surface of the panels allows for mounting of exhibit items 90. The exhibit items 90 are releasably secured to the front surface of the panels by means of rear mounted adhesive pads 92 with hook material which cooperatively engages the loop like material covering the front surfaces 24, 34, 44 of the panels in a manner that allows the exhibit items to be attached to and released from the panels so that the display case 10 may be used for different presentations.

FIG. 4 depicts a cross sectional view of the center panel 20 of the display case 10. The following discussion will reference center panel 20, but the wing panels 30, 40 are constructed in the same manner. The main portion of the panel is a core board 100. The core board is made from any lightweight rigid material. In the preferred embodiments of the display case 10, the core board 100 is made from a rigid polystyrene foam material that is faced on both sides by smooth moisture resistant wood fiber veneers. The foam and the veneers are permanently bonded together. The face laminates on the foam core 100 provide an excellent surface for painting, silk screening, laminating and photo mounting.

The front surface 24 of the center-panel 20 is comprised of a Velcro® compatible material mounted to one side of core board 100. The Velcro® compatible material is applied to the veneer surface of the core board 100 using a water based glue that is applied to the surface of the veneer. The Velcro® compatible material allows the user of the display case 10 to easily attach and remove exhibit items to the front surface of the panels.

The rear surface 22 of the center panel 20 is comprised of a thermoplastic polymer material. The preferred material for the rear surface of the panels is acrylonitrile butadiene styrene (ABS). The support frame 70 is mounted over the edges of the rear ABS surface 22, core board 100, and the Velcro® front surface 24, and overlaps a top portion of the front surface 24 and the rear surface 22 of the center panel 20. The support frame 70 is made from a rigid customized polyvinyl chloride (PVC) compound, but is not limited to just this material and may be made from any suitably rigid material.

As best seen in FIG. 4 the support frame 70 has a lip 72 which extends over the front surface 24 of the core board 100 and beyond the surface of the mounted exhibit items 90, thereby allowing the display items 90 to remain secured to the front surface of the panels when the display case 10 is in a closed position. This feature allows someone to arrange the display case 10 prior to their presentation and transport the display case 10 with the exhibit items 90 already in place.

To create the display case 10 the Velcro® compatible material is applied to the front of each core board using a water based glue that is first applied to the veneer forming the facing of the core board 100. Thermoformed ABS panels are then mounted to the rear side of each core board 100. The thermoform process requires heating and forming the ABS, which creates the ribbed pattern 50 and the recessed area 60 on which a logo may be affixed. The edges of the sandwich created by the ABS panels, the core board 100, and the Velcro® material are then framed with PVC, adhesively attached by means of a hot glue gun. The handle 80 is then riveted to frame 70 in the middle of the center panel 20.

The ABS and Velcro® compatible materials on the front 24 and rear 22 surfaces of the panels come in varying colors so the display case 10 may be customized for any individual customer. With the availability of customized colors and the added feature of the exterior logo affixing area 60, the display case 10 becomes a personalized advertising piece itself. A logo affixed to the display area 60 allows the display case 10 to act as a marketing tool even while it is in the closed position.

The presentation display case 10 is offered in varying sizes depending on the needs of the user, including, but not limited to, 18 inches, 24 inches and 32 inches. The general design of the display case is the same no matter what the size of the case is. The total weight of the display case, depending on the size of the case, is between five and ten pounds. Typical existing display cases weigh nearly three times this weight.

It is to be understood that the present invention is not limited to the embodiments described above, but encompasses any and all embodiments within the scope of the following claims.

I claim:

1. A portable presentation display case comprising:

a plurality of lightweight, rigid panels, each panel having a front surface and a rear surface, wherein the front surface is covered with a first covering of hook fastener compatible material and the rear surface is covered with a second covering of a rigid thermoplastic polymer layer, said thermoplastic polymer layer having an inner surface facing said panel and an outer surface;

said second covering of each of said plurality of panels being thermoformed with a plurality of ribs, and said second covering of at least one of said plurality of panels being thermoformed with a centrally located recessed area;

whereby said ribs provide a high degree of rigidity to the rear surface of each said panel, and the recessed area provides further structural integrity to said at least one panel as well as providing an area to which a logo or other advertising indicia may be affixed;

each panel of said plurality of panels having a rigid, channel-shaped support frame surrounding and encapsulating the edges of said panel and the edges of said first and second coverings;

a hinge connecting said panels to one another allowing the panels to fold from an open position to a closed position; and a handle fixedly secured to the top of one of said panels;

whereby in said open position the portable presentation display is a free standing display device for exhibiting objects of interest, and in said closed position the panels are folded providing a light weight portable presentation display that allows for display of objects of interest on said outer surface.

2. The portable presentation display case of claim 1, wherein each of said panels is formed from a rigid polystyrene foam material.

3. The portable presentation display case of claim 1, wherein the rear surface second covering of each of said plurality of panels is formed of acrylonitrile butadiene styrene (ABS).

4. The portable presentation display case of claim 1, wherein said support frame is formed from a rigid polyvinyl chloride (PVC) compound.

5. The portable presentation display case of claim 4, wherein said support frame has a lip that extends slightly beyond said front surface.

6. The portable presentation display case of claim 1, wherein the display case is comprised of a center panel, and two outer panels, the outer panels approximately half the width of the center panel.

7. A portable presentation display case comprising:

a center panel and two hingedly connected wing panels, the panels formed of lightweight rigid material, each panel having a front surface and a rear surface, wherein the front surface of each said panel is covered with a hook fastener compatible material and the rear surface of each said panel is covered with a rigid material, said rigid material having an inner surface facing said panel and an outer surface, and wherein the wing panels are approximately half the width of the center panel;

said rigid material covering the rear surface of each said panels being thermoformed with a plurality of ribs, and said rigid material covering the rear surface of at least one of said plurality of panels being thermoformed with a centrally located recessed area;

whereby said ribs provide a high degree of rigidity to the rear surface of each said panel, and the recessed area provides further structural integrity to said at least one panel as well as providing an area to which a logo or other advertising indicia may be affixed;

a PVC support frame surrounding and encapsulating the edge of each of said panels and said front and rear surfaces; and a handle fixedly secured to the top of one of said panels;

whereby in an open position the portable presentation display is a free standing display device for exhibiting objects of interest, and in a closed position the panels are folded providing a light weight portable presentation display that allows for display of objects of interest on said outer surface.

8. The portable presentation display case of claim 7, wherein said support frame has a lip that extends slightly beyond said front surface.

9. The portable presentation display case of claim 7, further including a strap for securing said two wing panels in said closed position;

said strap having a first end affixed to the rear of said center panel, and a second end removably secured to said two wing panels when said wing panels are in said closed position.

10. The portable presentation display case of claim 9, wherein said strap is removably secured to said two wing panels by mating sections of hook and loop fastening means on the second end of said strap and said wing panels, respectively.

* * * * *